US009351542B2

(12) United States Patent
Chiang et al.

(10) Patent No.: US 9,351,542 B2
(45) Date of Patent: May 31, 2016

(54) BUCKLE ASSEMBLY

(71) Applicant: Plus Meditech Co., Ltd., Tainan (TW)

(72) Inventors: Yueh-Hua Chiang, Taipei (TW); Fu-Lin Chuang, Tainan (TW)

(73) Assignee: PLUS MEDITECH CO., LTD., Tainan (TW)

( * ) Notice: Subject to any disclaimer, the term of this patent is extended or adjusted under 35 U.S.C. 154(b) by 17 days.

(21) Appl. No.: 14/197,919

(22) Filed: Mar. 5, 2014

(65) Prior Publication Data

US 2015/0135492 A1 May 21, 2015

(30) Foreign Application Priority Data

Nov. 19, 2013 (TW) ..... 102142048 A

(51) Int. Cl.
*A44B 11/25* (2006.01)
*A44B 11/28* (2006.01)

(52) U.S. Cl.
CPC ..... *A44B 11/2588* (2013.01); *A44B 11/28* (2013.01); *Y10T 24/4522* (2015.01); *Y10T 24/45241* (2015.01); *Y10T 24/45272* (2015.01); *Y10T 24/45984* (2015.01)

(58) Field of Classification Search
CPC ..... A44B 11/2588; A44B 11/258; A44B 11/2592; A44B 11/2596; A41F 1/006; Y10T 24/3403; Y10T 24/45; Y10T 24/45152; Y10T 24/45215; Y10T 24/45222; Y10T 24/4523; Y10T 24/45241; Y10T 24/45969; Y10T 24/45984; Y10T 24/4599
See application file for complete search history.

(56) References Cited

U.S. PATENT DOCUMENTS 3,418,700 A * 12/1968 Edelman ..... 24/578.1
3,445,901 A * 5/1969 Kamper ..... 24/618
3,837,049 A * 9/1974 Corrado ..... 450/82

* cited by examiner

*Primary Examiner* — Robert J Sandy
*Assistant Examiner* — Michael Lee
(74) *Attorney, Agent, or Firm* — Muncy, Geissler, Olds & Lowe, P.C.

(57) ABSTRACT

A buckle assembly includes female and male buckle plates. The female buckle plate is formed with an insertion slot defined by a slot-defining wall having first and second wall faces, and has first and second corners. The first and second corners oppose each other, and are different in height with respect to a reference plane. The male buckle plate has a bent end portion that has upper and lower segments and a middle segment cooperating with the upper and lower segments to define upper and lower corners. The bent end portion is pivotable to the first corner by abutting the upper corner against the first corner, such that the bent end portion is rotatable relative to the first corner.

5 Claims, 11 Drawing Sheets

BUCKLE ASSEMBLY

CROSS-REFERENCE TO RELATED APPLICATION

This application claims priority of Taiwanese Application No. 102142048, filed on Nov. 19, 2013.

BACKGROUND OF THE INVENTION

1. Field of the Invention

This invention relates to a buckle assembly, more particularly to a buckle assembly that includes a female buckle plate having a slot-defining wall that has first and second corners which are different in height with respect to a reference plane.

2. Description of the Related Art

U.S. Patent Application Publication No. 2013/0232743 discloses a buckle assembly that includes male and female buckle parts which are releasably engageable to each other through engaging portions. Two opposite legs are included in the buckle assembly, and are pressable to disengage the male and female buckle parts. However, pressing of the legs to disengage the male and female buckle parts is relatively inconvenient.

FIG. 1 illustrates a conventional quick release buckle assembly that includes a female buckle piece 11 and a male buckle piece 12. The female buckle piece 11 is formed with an insertion slot 111 that has a width (a) and that is defined by a slot-defining wall 110. The male buckle piece 12 has a generally L-shaped tongue 120 and a protrusion 125. The L-shaped tongue 120 is extendable into the insertion slot 111, and has a first segment 121 and a second segment 122 that is bent from and that cooperates with the first segment 121 to define an inner corner 123. The inner corner 123 has an inner face 1231. The first segment 121 has a width (b). The protrusion 125 protrudes from the inner corner 123, and defines an outer corner face 1251. The width (a) of the insertion slot 111 is required to be equal to or greater than a distance (c) between a center of the inner face 1231 and a center of the outer face 1251, so as to permit insertion of the L-shaped tongue 120 and the protrusion 125 through the insertion slot 111. However, since the width (b) of the first segment 121 is smaller than the width (a) of the insertion slot 111, a gap 113 exists between the first segment 121 and the slot-defining wall 110 and engagement between the female and male buckle pieces 11, 12 is loose. In addition, disengagement between the female and male buckle pieces 11, 12 is inconvenient attributed to a potential interference between the protrusion 125 and the slot-defining wall 110.

SUMMARY OF THE INVENTION

Therefore, an object of the present invention is to provide a buckle assembly that can overcome the aforesaid drawbacks associated with the prior art.

According to the present invention, there is provided a buckle assembly that comprises female and male buckle plates. The female buckle plate has top and bottom surfaces and a slotted end portion. The slotted end portion is formed with an insertion slot that extends through the top and bottom surfaces and that is defined by a slot-defining wall. The slot-defining wall has a first wall face that extends from the top surface to the bottom surface, and a second wall face that extends from the top surface to the bottom surface and that is spaced apart from and that opposes the first wall face. The top surface cooperates with the first and second wall faces to define first and second corners, respectively. The second wall face is perpendicular to a reference plane and having an edge that lies on the reference plane. The first wall face is perpendicular or substantially perpendicular to the reference plane. The first and second corners oppose each other, and are different in height with respect to the reference plane. The male buckle plate has a bent end portion that is extendable into and through the insertion slot. The bent end portion has an upper segment with upper and lower faces, a lower segment with upper and lower faces, and a middle segment that is bent from the upper and lower segments, and that cooperates respectively with the upper face of the upper segment and the lower face of the lower segment to define upper and lower corners, respectively. The bent end portion is pivotable to the first corner by abutting the upper corner against the first corner, such that the bent end portion is rotatable relative to the first corner between disengaging and engaging positions. When the bent end portion is disposed at the disengaging position, the lower corner abuts against the second corner and is disposed above the second corner with respect to the reference plane. When the bent end portion is disposed at the engaging position, the lower corner is disposed below the second corner with respect to the reference plane and is in snap-fit engagement with the second corner.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
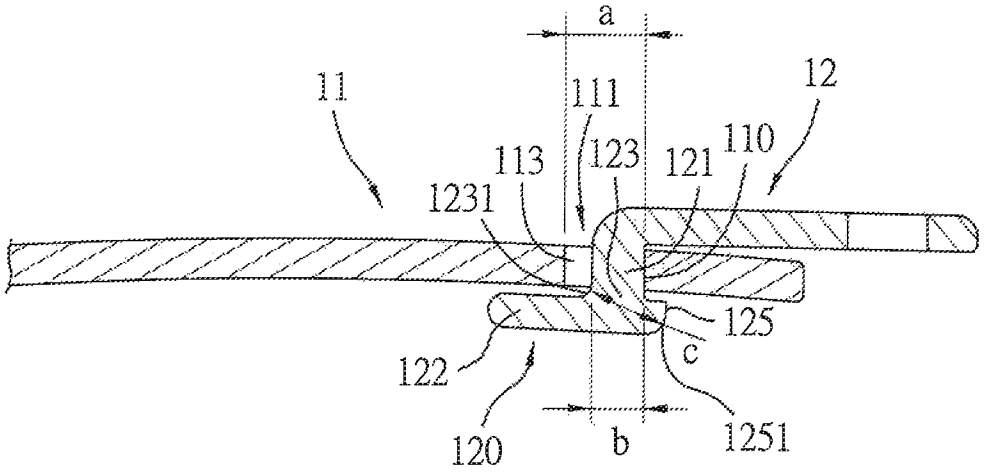
FIG. 1 PRIOR ART
FIG. 1 is a fragmentary sectional view of a conventional buckle assembly.
Figure 2:
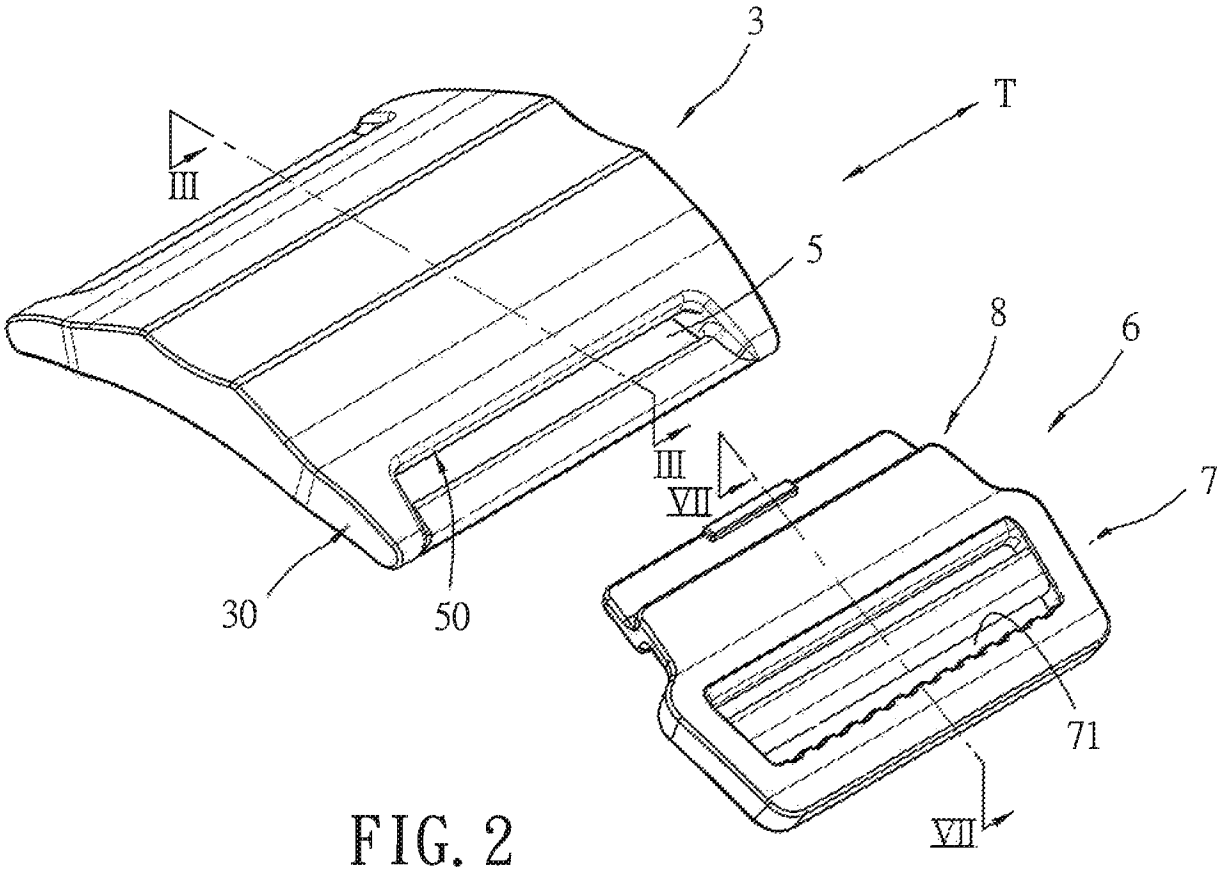
FIG. 2 is a perspective view of the preferred embodiment of a buckle assembly according to the present invention in a disengaging state.
Figure 3:
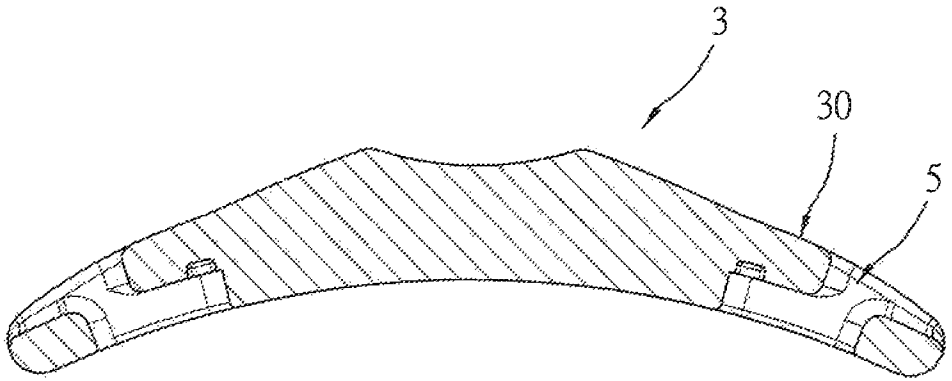
FIG. 3 is a sectional view taken along lines III-III of FIG. 2.
Figure 4:
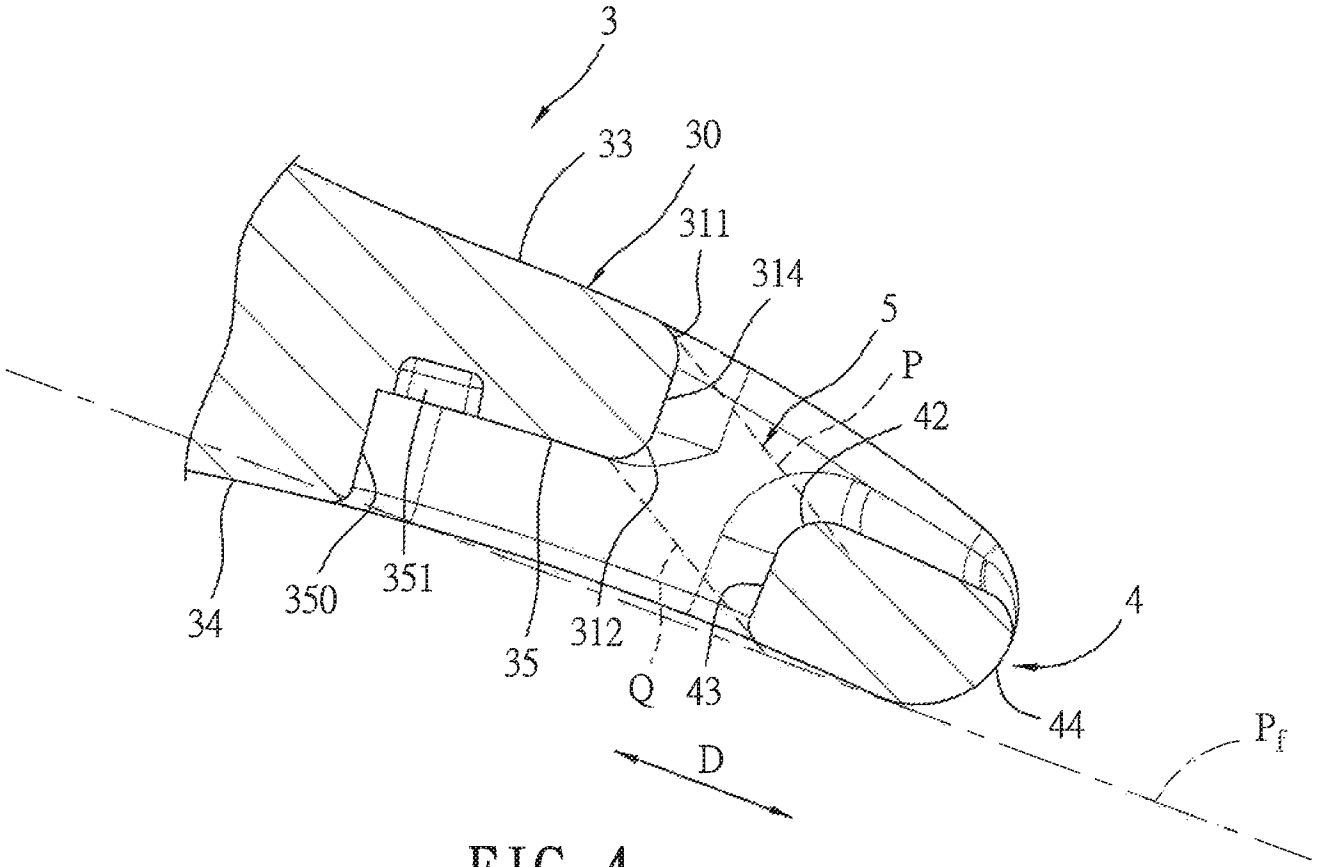
FIG. 4 is an enlarged fragmentary sectional view of a female buckle plate of the preferred embodiment.
Figure 5:
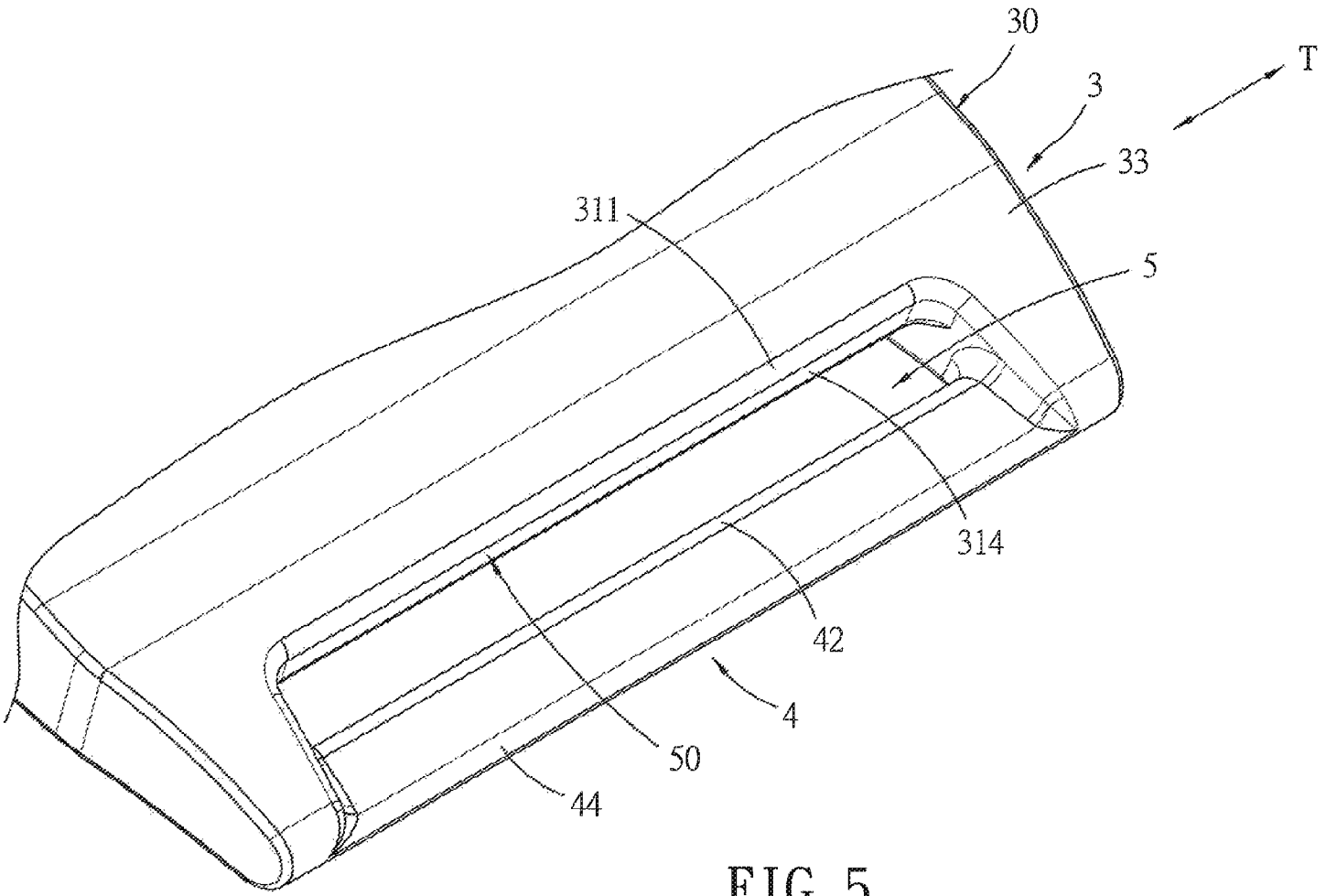
FIG. 5 is an enlarged fragmentary perspective top view of the female buckle plate of the preferred embodiment.
Figure 7:
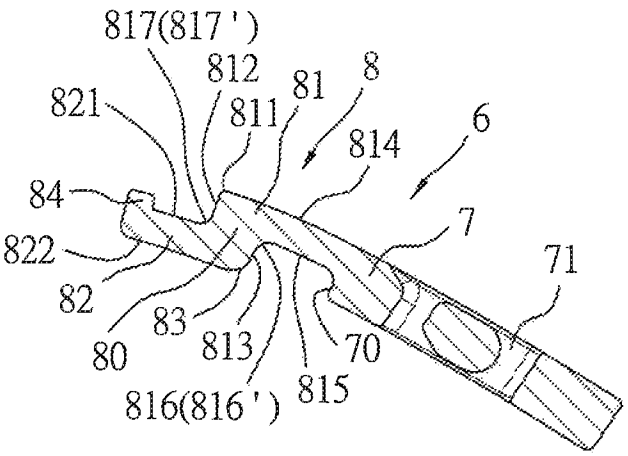
FIG. 7 is a sectional view taken along lines VII-VII of FIG. 2.
Figure 6:
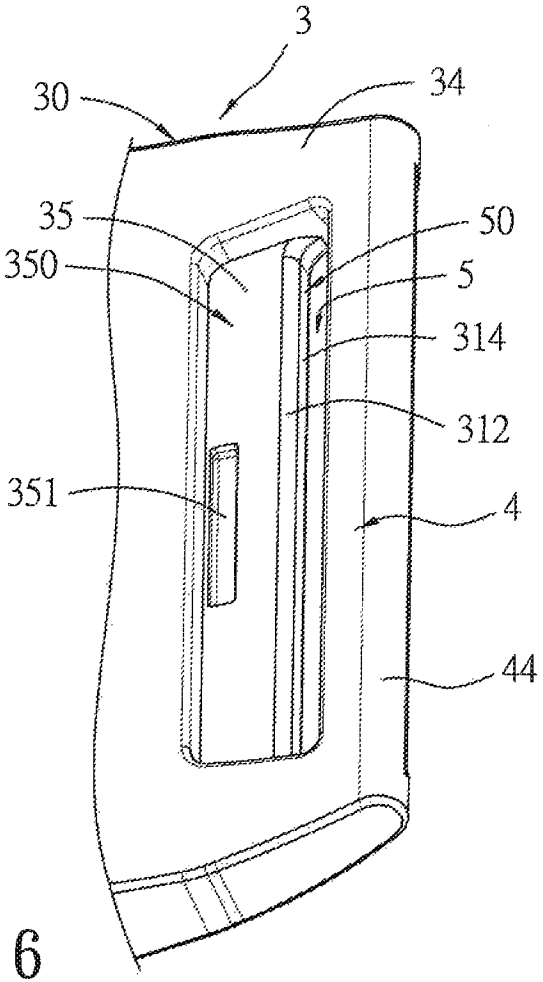
FIG. 6 is an enlarged fragmentary perspective bottom view of the female buckle plate of the preferred embodiment.

FIGS. 2 to 7 illustrate the preferred embodiment of a buckle assembly according to the present invention. The buckle assembly includes female and male buckle plates 3, 6.

The female buckle plate 3 has top and bottom surfaces 33, 34 and a slotted end portion 30. The slotted end portion 30 is formed with an insertion slot 5 that extends through the top and bottom surfaces 33, 34 and that is defined by a slot-defining wall 50. The slot-defining wall 50 has a first wall face 314 that extends from the top surface 33 to the bottom surface 34, and a second wall face 43 that extends from the top surface 33 to the bottom surface 34 and that is spaced apart from and that opposes the first wall face 314. The top surface 33 cooperates with the first and second wall faces 314, 43 to define first and second corners 311, 42, respectively. The second wall face 43 is perpendicular to a reference plane ($P_f$) and has an edge that lies on the reference plane ($P_f$). The first wall face 314 is perpendicular or substantially perpendicular to the reference plane ($P_f$). The first and second corners 311, 42 oppose each other, and are different in height with respect to the reference plane ($P_f$). The second corner 42 extends in a transverse direction (T). The first corner 311 extends in a direction substantially parallel to the transverse direction (T).

Figure 9:
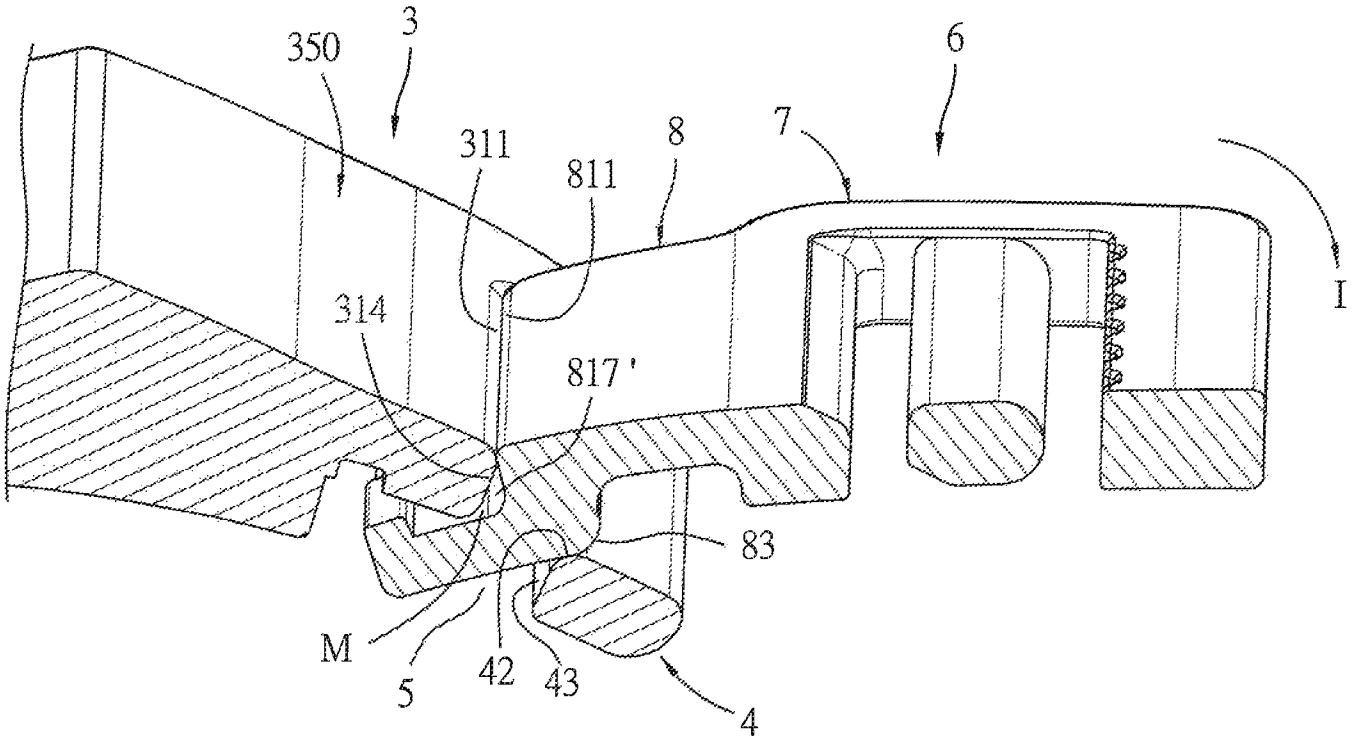
FIG. 9 is a sectional view illustrating a state where a bent end portion of the male buckle plate of the preferred embodiment is disposed at a disengaging position.

The male buckle plate 6 has an operating end portion 7 and a bent end portion 8 that is extendable into and through the insertion slot 5. The bent end portion 8 has an upper segment 81 with upper and lower faces 814, 815, a lower segment 82 with upper and lower faces 821, 822, and a middle segment 80 that is bent from the upper and lower segments 81, 82 and that cooperates respectively with the upper face 814 of the upper segment 81 and the lower face 822 of the lower segment 82 to define upper and lower corners 811, 83, respectively. The middle segment 80 and each of the upper and lower segments 81, 82 cooperatively form a generally L-shaped structure, and cooperates with the upper and lower segments 81, 82 to form a generally Z-shaped structure. The lower corner 83 extends in the transverse direction (T). The upper corner 811 extends in a direction substantially parallel to the transverse direction (T). The bent end portion 8 is pivotable to the first corner 311 by abutting the upper corner 811 against the first corner 311, such that the bent end portion 8 is rotatable relative to the first corner 311 between disengaging and engaging positions (see FIGS. 9 and 10). When the bent end portion 8 is disposed at the disengaging position (see FIG. 9), the lower corner 83 abuts against the second corner 42 and is disposed above the second corner 42 with respect to the reference plane (Pr). When the bent end portion 8 is disposed at the engaging position (see FIG. 10), the lower corner 83 is disposed below the second corner 42 with respect to the reference plane ($P_f$) and is in snap-fit engagement with the second corner 42.

In this embodiment, the middle segment 80 has a first side face 812 that extends between the upper faces 814, 821 of the upper and lower segments 81, 82, and a second side face 813 that extends between the lower faces 815, 822 of the upper and lower segments 81, 82. The middle segment 80 is tightly fitted into the insertion slot 5, such that the first and second side faces 812, 813 respectively abut against the first and second wall faces 314, 43 when the bent end portion 8 is disposed at the engaging position.

Figure 11:
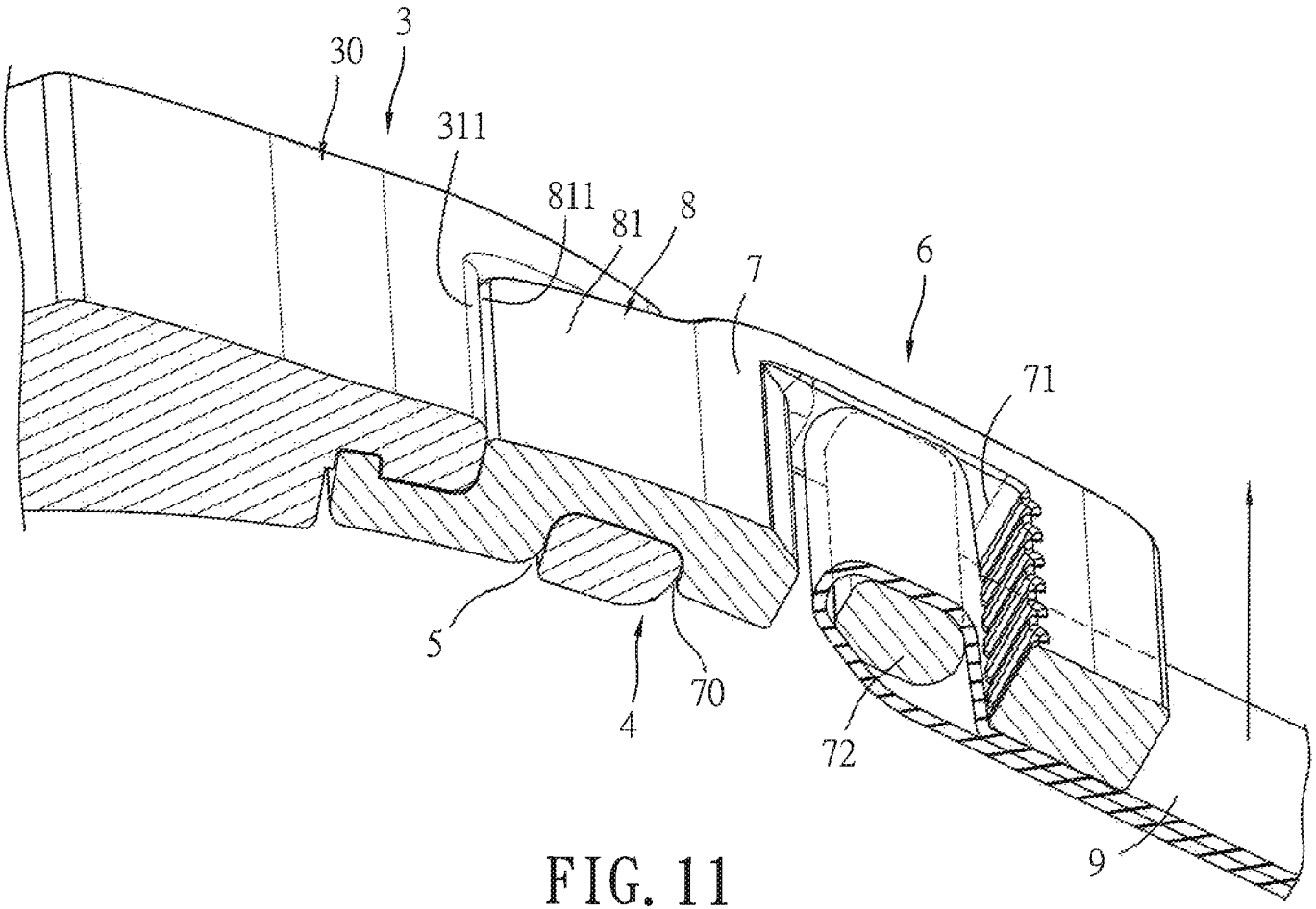
FIG. 11 is a sectional view illustrating how the bent end portion of the male buckle plate of the preferred embodiment is operated to disengage the male buckle plate from the female buckle plate through a strap.

The operating end portion 7 is disposed opposite to the bent end portion 8, extends from an end of the upper segment 81 of the bent end portion 8 which is opposite to the upper corner 811, and is formed with a strap-receiving hole 71. A strap-holding bar 72 is disposed in the strap-receiving hole 71, and is connected to a strap 9 (see FIG. 11). The operating end portion 7 cooperates with the middle segment 80 and the upper segment 81 to define a generally U-shaped first recess 70. The slotted end portion 30 has a free end face 44 and an engaging segment 4 that extends from the second wall face 43 to the free end face 44 and that is received fittingly in the first recess 70 when the bent end portion 8 is disposed at the engaging position.

The bottom surface 34 of the female buckle plate 3 has an L-shaped surface region 35 that defines a second recess 350 and that is formed with a groove 351. The lower segment 82 is formed with a protrusion 84. The L-shaped surface region 35 extends from and cooperates with the first wall face 314 to define a third corner 312 that is disposed below the first corner 311. The lower segment 82 extends into the second recess 350 and the protrusion 84 engages the groove 351 when the bent end portion 8 is disposed at the engaging position.

The second corner 42 overlaps the third corner 312 in a normal direction (D) that is normal to the second wall face 43 and that is normal to or substantially normal to the first wall face 314.

The middle segment 80 further cooperates with the upper and lower segments 81, 82 to define first and second corner recesses 816, 817, respectively.

The first and second corner recesses 816, 817 are defined by first and second recess-defining faces, 816', 817', respectively. The second and third corners 42, 312 are respectively received in the first and second corner recesses 816, 817 when the bent end portion 8 is disposed at the engaging position.

Figure 8:
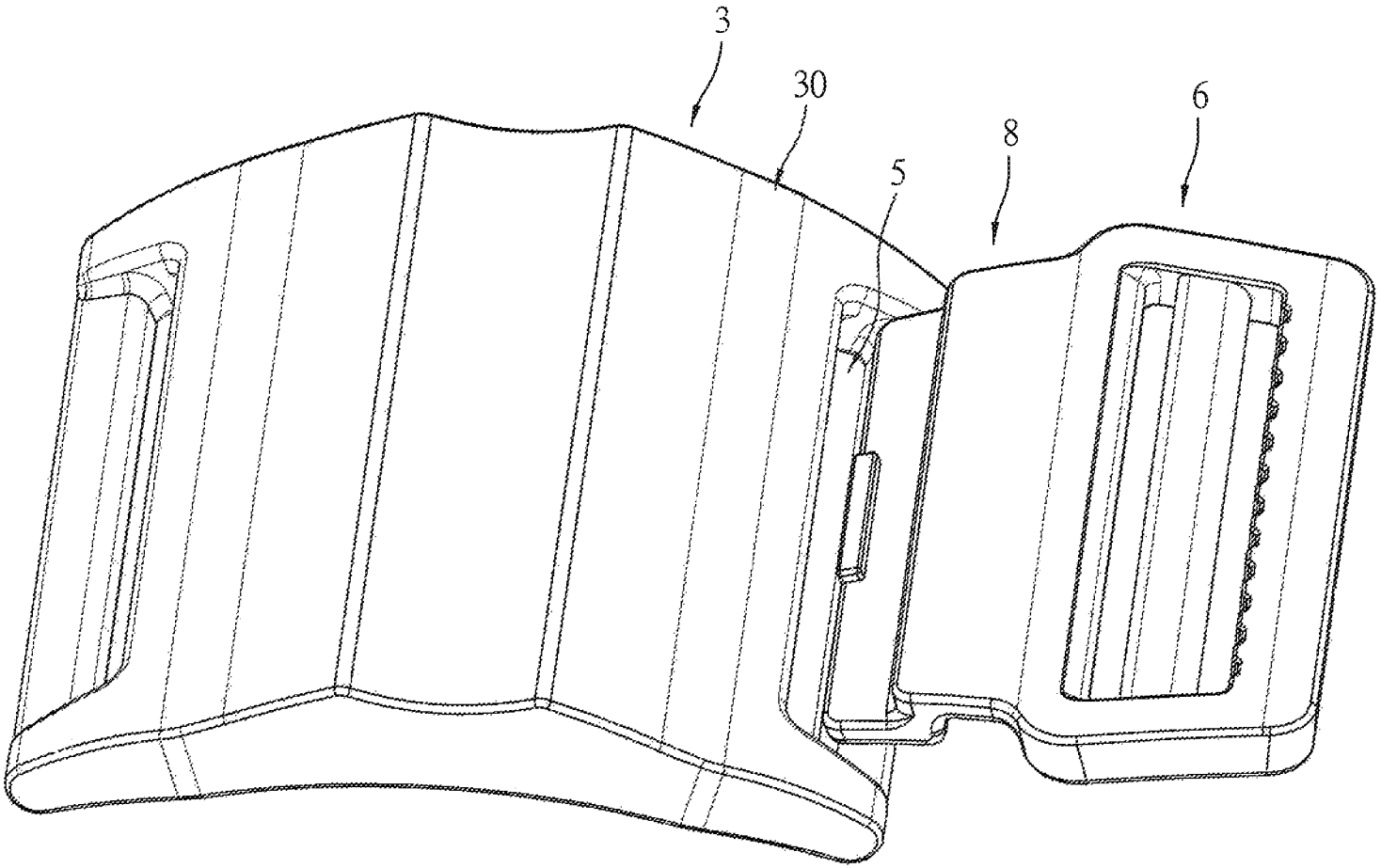
FIG. 8 is a perspective view illustrating how a male buckle plate engages the female buckle plate of the preferred embodiment.
Figure 10:
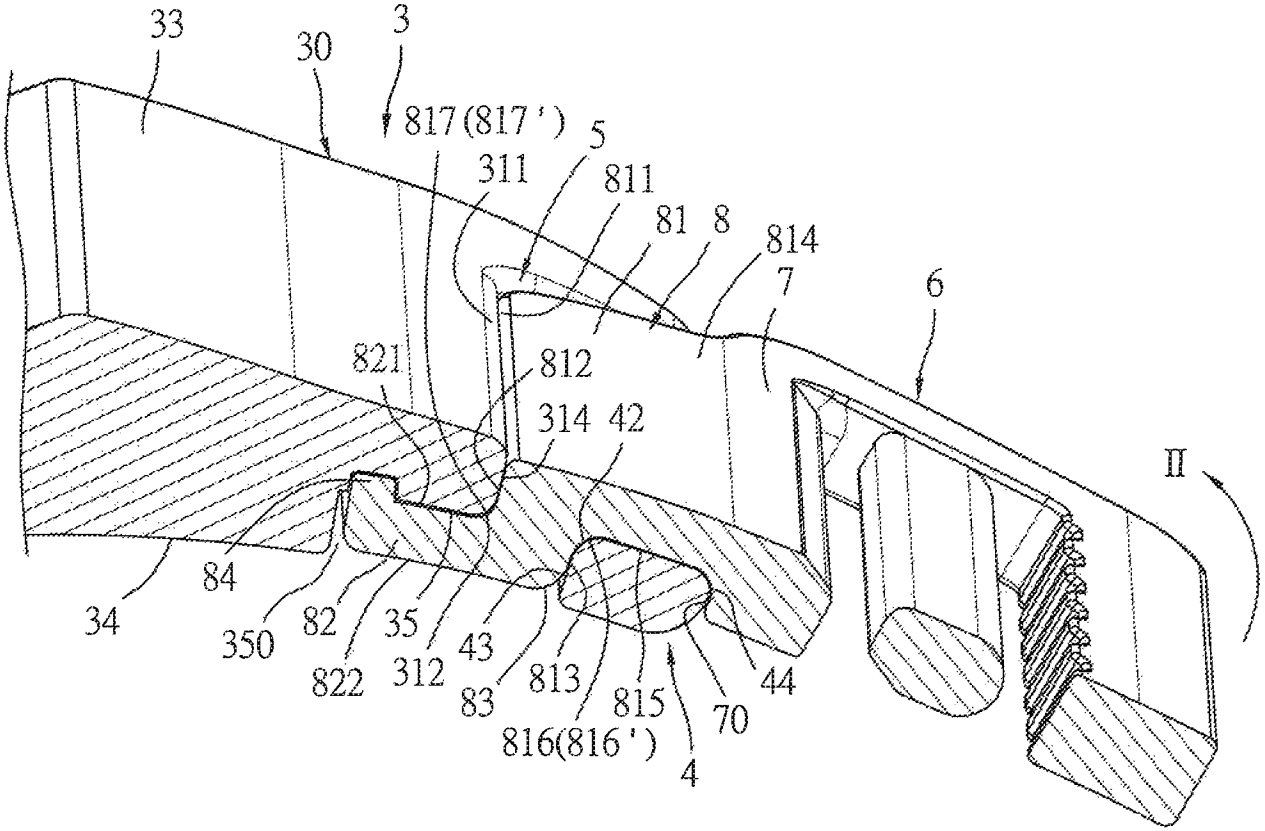
FIG. 10 is a sectional view illustrating a state where the bent end portion of the male buckle plate of the preferred embodiment is disposed at an engaging position.

To engage the male buckle plate 6 with the female buckle plate 3, the bent end portion 8 of the male buckle plate 6 is extended into the insertion slot 5 (see FIG. 8), followed by abutting the upper and lower corners 811, 83 against the first corner 311 and an upper edge of the second corner 42, respectively, and pressing the operating end portion 7 downwardly along a downward rotational direction (I) (see FIG. 9) to permit snap-fit engagement between the lower corner 83 and the second corner 42 (see FIG. 10).

To disengage the male buckle plate 6 from the female buckle plate 3, the operating end portion 7 is pulled upwardly along an upward rotational direction (II) to permit disengagement between the lower corner 83 and the second corner 42 (see FIG. 10) and movement of the bend end portion 8 to the disengaging position. The pulling of the operating end portion 7 may be performed through the strap 9 (see FIG. 11).

Figure 12:
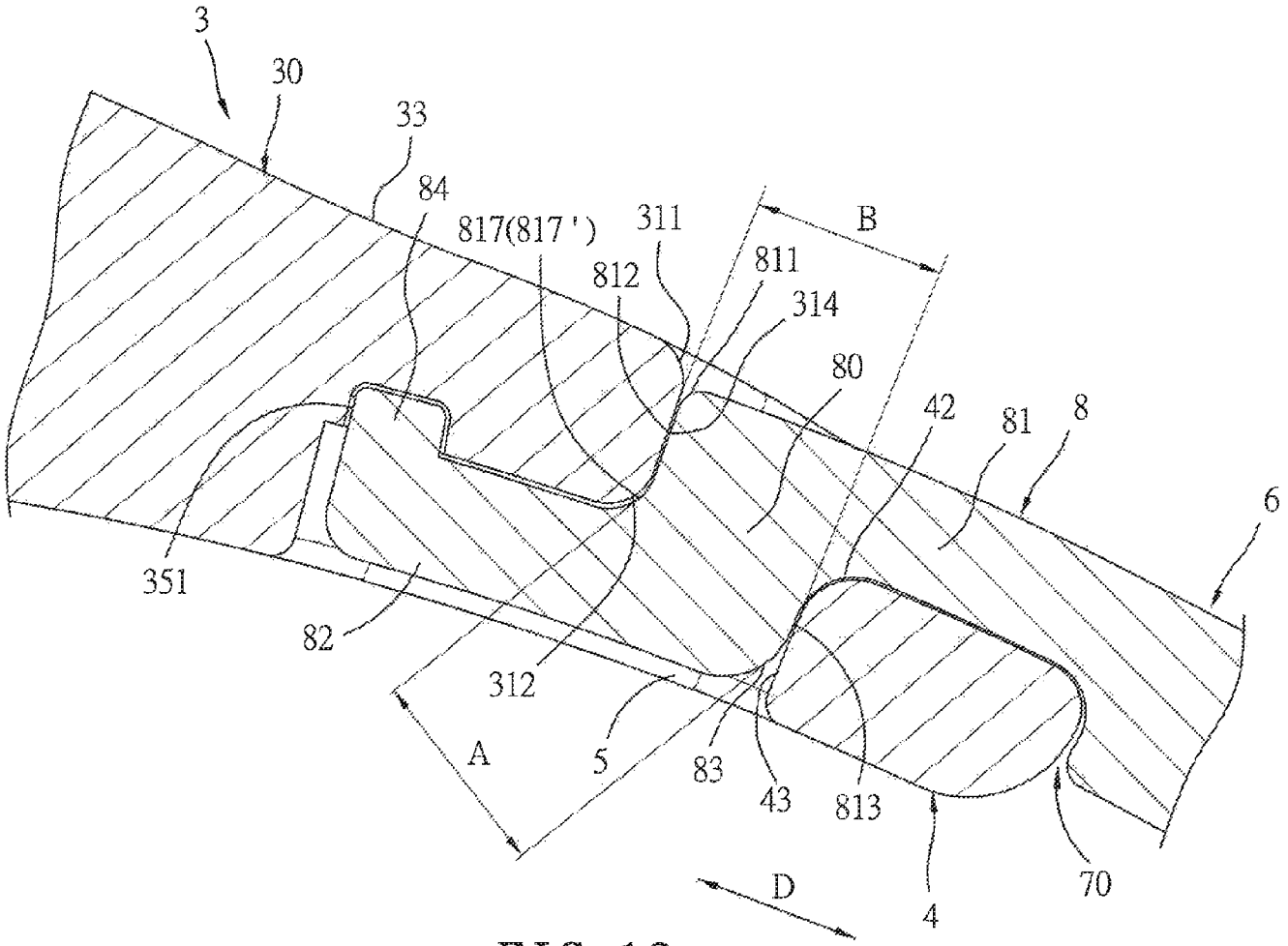
FIG. 12 is an enlarged fragmentary sectional view of the preferred embodiment.

Referring to FIG. 12, the maximum distance (A) between the lower corner 83 and the second recess-defining face 817' of the second corner recess 817 is greater than the maximum distance (B) between the first and second wall faces 314, 43. The second corner 42 is disposed at a lower level than the first corner 311 with respect to the reference plane ($P_f$) (see FIG. 4), so that the insertion slot 5 can be parallelogram-shaped (with upper and lower sides being slanted with respect to the reference plane ($P_f$)) (note that the parallelogram may be roughly defined by imaginary lines (P, Q) of FIG. 4 and the first and second wall faces 314, 43) and a clearance (M) (see FIG. 9) between the second recessed face 817' and the first wall face 314 can be created, thereby permitting squeezing of the lower corner 83 to pass over the second corner 42 as the upper corner 811 pivotally abuts against the first corner 311 during snap-fit engaging or disengaging of the lower corner 83 with the engaging segment 4. In addition, since the second corner 42 and the third corner 312 overlap each other in the normal direction (D) and abut against the middle segment 80, the male buckle plate 6 is prevented from moving in the normal direction (D). The engagements between the protrusion 84 and the groove 351 and between the engaging segment 4 and the first recess 70 further enhance securing of the male buckle plate 6 to the female buckle plate 3.

By lowering the second corner 42 with respect to the first corner 311 of the slotted end portion 30 of the female buckle plate 3 of the buckle assembly of the present invention, the aforesaid drawbacks associated with the prior art can be alleviated.

While the present invention has been described in connection with that is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A buckle assembly comprising:

a female buckle plate having top and bottom surfaces and a slotted end portion, said slotted end portion being formed with an insertion slot that extends through said top and bottom surfaces and that is defined by a slot-defining wall, said slot-defining wall having a first wall face that extends from said top surface to said bottom surface, and a second wall face that extends from said top surface to said bottom surface and that is spaced apart from and that opposes said first wall face, said top surface cooperating with said first and second wall faces to define first and second corners, respectively, said second wall face being perpendicular to a reference plane and having an edge that lies on the reference plane, said first wall face being perpendicular or substantially perpendicular to said reference plane, said first and second corners opposing each other and being different in height with respect to said reference plane; and a male buckle plate having a bent end portion that is extendable into and through said insertion slot, said bent end portion having an upper segment with upper and lower faces, a lower segment with upper and lower faces, and a middle segment that is bent from said upper and lower segments and that cooperates respectively with said upper face of said upper segment and said lower face of said lower segment to define upper and lower corners, respectively;

wherein said bent end portion is pivotable to said first corner by abutting said upper corner against said first corner, such that said bent end portion is rotatable relative to said first corner between disengaging and engaging positions;

wherein when said bent end portion is disposed at said disengaging position, said lower corner abuts against said second corner and is disposed above said second corner with respect to said reference plane;

wherein when said bent end portion is disposed at said engaging position, said lower corner is disposed below said second corner with respect to said reference plane and is in snap-fit engagement with said second corner; and wherein said lower segment is formed with a protrusion and said bottom surface of said female buckle plate has an L-shaped surface region that defines a second recess and that is formed with a groove extending into the L-shaped surface region configured to receive the protrusion.

2. The buckle assembly of claim 1, wherein said middle segment has a first side face that extends between said upper faces of said upper and lower segments, and a second side face that extends between said lower faces of said upper and lower segments, said middle segment being tightly fitted into said insertion slot, such that said first and second side faces respectively abut against said first and second wall faces when said bent end portion is disposed at said engaging position.

3. The buckle assembly of claim 1, wherein said male buckle plate further has an operating end portion that is opposite to said bent end portion and that extends from an end of said upper segment which is opposite to said upper corner, said operating end portion cooperating with said middle segment and said upper segment to define a generally U-shaped first recess, said slotted end portion having a free end face and an engaging segment that extends from said second wall face to said free end face and that is received fittingly in said first recess when said bent end portion is disposed at said engaging position.

4. The buckle assembly of claim 1, wherein said L-shaped surface region extends from and cooperates with said first wall face to define a third corner that is disposed below said first corner, said lower segment extending into said second recess and said protrusion engaging said groove when said bent end portion is disposed at said engaging position.

5. The buckle assembly of claim 4, wherein said middle segment further cooperates with said upper and lower segments to define first and second corner recesses, respectively, said second and third corners being respectively received in said first and second corner recesses when said bent end portion is disposed at said engaging position.

* * * * *